US005966502A

United States Patent [19]

Pearce

[11] Patent Number: 5,966,502

[45] Date of Patent: Oct. 12, 1999

[54] APPARATUS FOR MELTING SNOW AND ICE

[75] Inventor: Richard J. Pearce, St. Petersburg, Fla.

[73] Assignee: Clearpath, Inc., St. Petersburg, Fla.

[21] Appl. No.: 08/910,776

[22] Filed: Aug. 13, 1997

[51] Int. Cl.[6] ..... A47J 31/00; F28F 3/12

[52] U.S. Cl. ..... 392/465; 165/169; 165/170

[58] Field of Search ..... 165/81, 83, 169, 165/170; 219/528, 213, 548; 392/465

[56] References Cited

U.S. PATENT DOCUMENTS

| | | | |
|---|---|---|---|
| 2,231,251 | 2/1941 | Chaney | 219/19 |
| 2,844,696 | 7/1958 | Custer, Jr. | 219/19 |
| 2,912,555 | 11/1959 | Jamison | 219/19 |
| 3,047,701 | 7/1962 | Frungel | 219/19 |
| 3,418,448 | 12/1968 | Pradenas | 219/213 |
| 3,812,320 | 5/1974 | Borgren | 219/213 |
| 4,423,308 | 12/1983 | Callaway et al. | 219/217 |
| 4,646,818 | 3/1987 | Ervin, Jr. | 165/703 |
| 4,967,057 | 10/1990 | Bayless | 219/213 |
| 5,003,157 | 3/1991 | Hargrove | 219/213 |
| 5,245,716 | 9/1993 | Callaway et al. | 5/451 |
| 5,380,988 | 1/1995 | Dyer | 219/548 |
| 5,395,179 | 3/1995 | Kotani | 404/71 |
| 5,591,365 | 1/1997 | Shields | 219/213 |
| 5,595,171 | 1/1997 | Makin | 126/271.1 |
| 5,605,418 | 2/1997 | Watanabe et al. | 405/131 |
| 5,614,292 | 3/1997 | Saylor | 428/209 |
| 5,637,247 | 6/1997 | Flynn, Jr. | 219/213 |
| 5,762,447 | 6/1998 | Hachiki et al. | 404/77 |

*Primary Examiner*—Teresa Walberg
*Assistant Examiner*—Thor S. Campbell
*Attorney, Agent, or Firm*—Joseph C. Mason, Jr.; Dennis G. LaPointe; Mason & Associates, PA

[57] ABSTRACT

A removable device for melting and preventing the accumulation of ice and snow on walkway and driveways is disclosed. The apparatus includes a series of interconnected pads of various lengths and widths which are heated to a temperature which is sufficient to prevent the accumulation of ice and snow.

4 Claims, 9 Drawing Sheets

APPARATUS FOR MELTING SNOW AND ICE

BACKGROUND OF THE INVENTION

1. Field of the Invention

This invention relates, generally, to an apparatus for melting snow and ice. More particularly, it relates to a removable device for preventing the accumulation of snow and ice on walkways and driveways by heating means.

2. Description of the Related Art

Heating elements have been used in the past to warm walkways and driving surfaces to prevent the accumulation of snow and ice. For example, U.S. Pat. Nos. 2,231,251, 2,844,696, 2,912,555, 3,047,701, 3,418,448, 3,812,320, 4,646,818, 4,967,057, 5,003,157, 5,380,988 and 5,591,365 disclose various devices useful in preventing the accumulation of snow and ice on walkways and driving surfaces. In general, these devices are relatively portable and are storable when not in use. U.S. Pat. No. 5,395,179 discloses a device which is a more permanent structure which can be flush with the ground surface to reduce the possibility of breakage of the inside heat generating elements.

However, all of these prior art devices have various shortcomings. For example, devices such as those disclosed in U.S. Pat. Nos. 5,591,365, 5,003,157 and 2,231,251 require the use of large quantities of electrical energy to heat and maintain a temperature sufficient to melt a relatively small surface area of ice and snow. The device disclosed U.S. Pat. No. 2,844,696 discloses a design which is impractical for exterior use and poses safety concerns including a potential shock hazard and short circuiting of the device, if it becomes submerged in melted snow and ice.

In addition, the device disclosed in U.S. Pat. No. 4,646,818, which is made up of individual tubes, is impractical for vehicular traffic. If enough weight is placed on one or more of the individual tubes, fluid flow is greatly diminished, if not completely blocked from a particular section of the device which allows the accumulation of ice and snow on the affected section. Further, the devices disclosed in U.S. Pat. Nos. 2,912,555, 3,418,448 and 5,380,988 are made up of rigid panels which restrict their usefulness to flat even surfaces and make movement and storage difficult.

Thus, what is needed then is an apparatus for melting and preventing the accumulation of snow and ice on walkways and driveways which is energy efficient, easily removable, storable when not in use and overcomes the problems associated with tube failure due to the weight of vehicular traffic or otherwise.

In view of the prior art as a whole at the time the present invention was made, it was not obvious to those of ordinary skill in the pertinent art how the apparatus could be provided.

SUMMARY OF THE INVENTION

In accordance with the present invention, an apparatus for melting ice and snow which includes a pad means; a pump means; a heater means; a temperature regulation means; and a pump control means is disclosed. The pad means includes a top panel, a bottom panel and two end panels. The top panel has evenly spaced vertical integral channels which run the length of the pad means. The bottom panel has evenly spaced horizontal integral channels which run the width of the pad means. The vertical channels and the horizontal channels are in fluid communication with each other. The pad means is in fluid communication with the pump means and the heater means and is also in electrical communication with the temperature regulation means and the pump control means. The pump control means is in electrical communication with the pump means.

The invention accordingly comprises the features of construction, combination of elements and arrangement of parts that will be exemplified in the description hereinafter set forth, and the scope of the invention will be indicated in the claims.

BRIEF DESCRIPTION OF THE DRAWINGS

For a fuller understanding of the nature of the invention, reference should be made to the following detailed description, taken in connection with the accompanying drawings, in which.

DETAILED DESCRIPTION OF THE INVENTION

Figure 1:
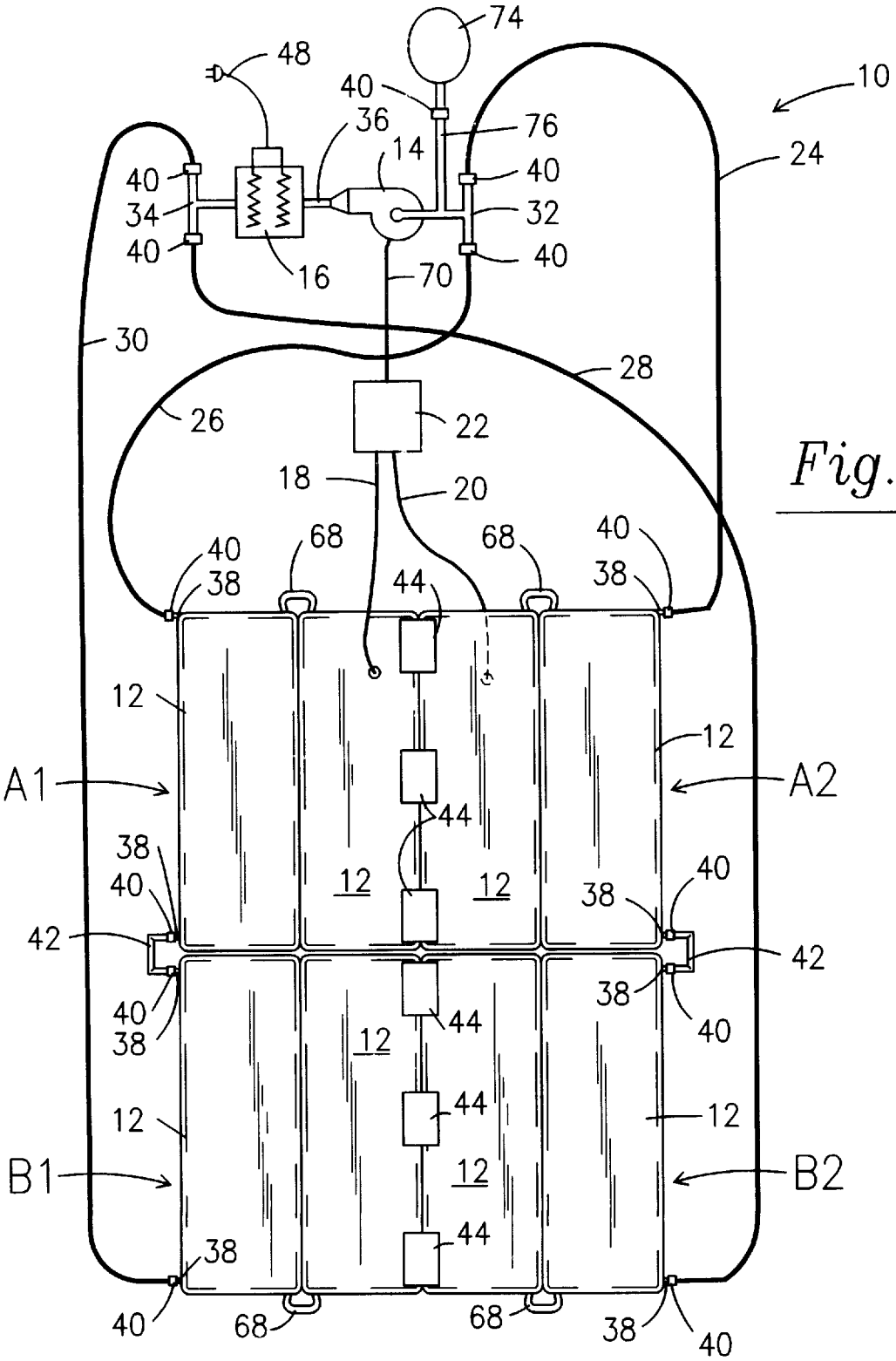
FIG. 1 is a top plan view of a heating apparatus system of the present invention.

Referring now to the drawings, in which like numerals refer to like elements thereof, FIG. 1 shows an embodiment of the novel apparatus for melting ice and snow of the present invention which is denoted as a whole by reference numeral 10. The apparatus 10 is a portable device which is useful in preventing the accumulation of snow and ice on sidewalks, pathways and driveways. The apparatus 10 has pad means 12, pump means 14, heater means 16, temperature regulation means 18 and 20 and pump control means 22. It is understood that the apparatus for melting ice and snow, of the present invention, can include only one pad means 12 or a plurality of pad means 12, depending on the surface area to be kept free from the accumulation of ice and snow. In addition, pad means 12 can be of various lengths and widths.

As shown in FIG. 1 the pad means 12 are in fluid communication with pump means 14 and heater means 16. Pump means 14 can be any pump mechanism, such as a reciprocating power pump, a steam pump, a rotary pump or a pistonless pump. As an illustrative example, pump means 14 typically maintains a minimum flow rate of 1.5 gallons per minute. However, adjustments in flow rate can be made based on temperature conditions and the surface area covered by pad means 12.

Pad means 12 are also in electrical communication with temperature regulation means 18 and temperature regulation means 20 which are in turn in electrical communication with pump control means 22. Pump control means 22 is also in electrical communication with pump means 14 via electrical cord 70. Preferably, heater means 16 is connected to an electrical power source (not shown) by electrical plug 48, however, other power sources are also contemplated by the present invention.

Figure 2:
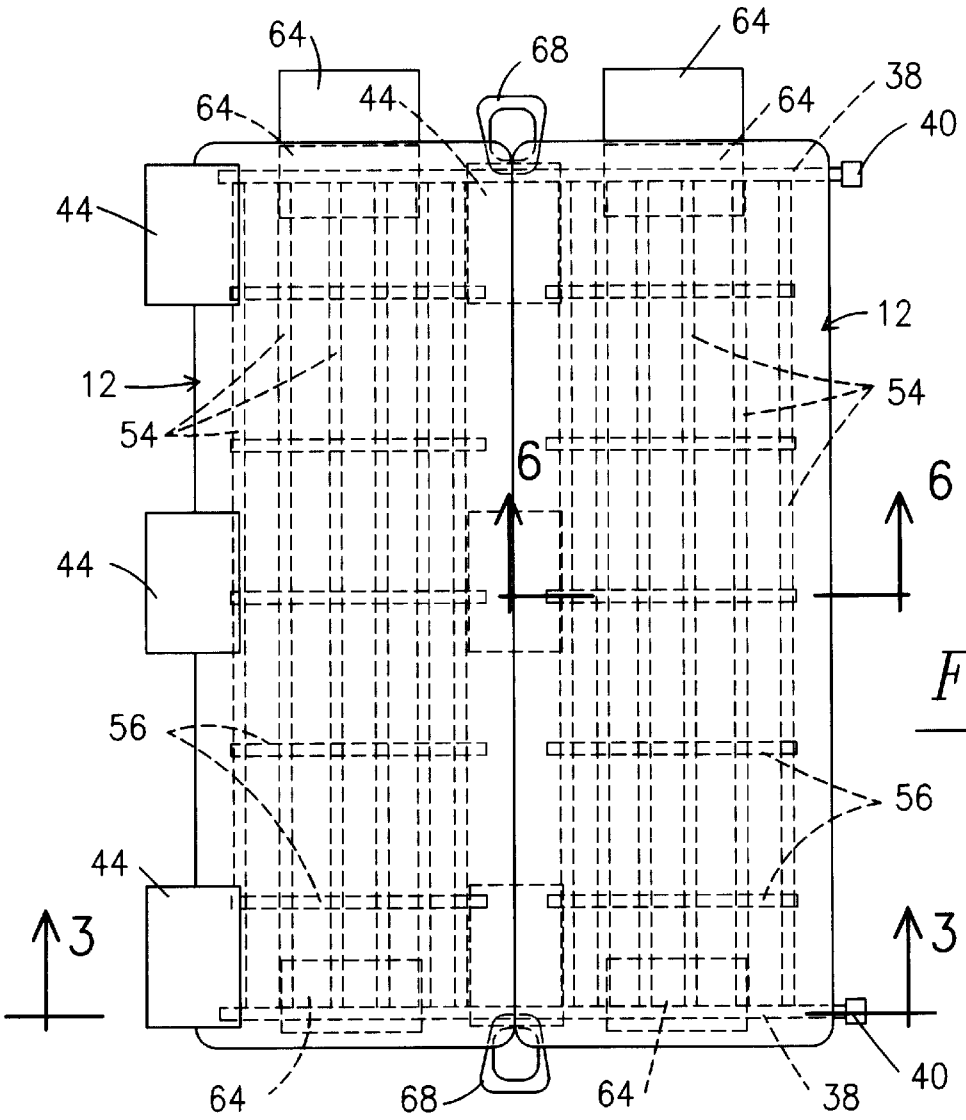
FIG. 2 is a top plan view showing additional structure of a pad assembly of the present invention.

As shown in FIG. 1, and in more detail in FIG. 2, two pad means 12 which have a fluid line 38 at each end form each of the pad assemblies A1, A2, B1 and B2 shown in FIG. 1. Pad assemblies A1 and A2 are connected to each other by interconnecting panels 44. Interconnecting panels 44 are oil resistant panels which are made of materials, such as, but not limited to, a neoprene impregnated fabric or similar material and bond pad assemblies A1 and A2 together. Interconnecting panels 44 also act as hinges during assembly, disassembly and storage. Similarly, pad assemblies B1 and B2 are connected by interconnected panels 44. Pad assemblies A1/A2 and B1/B2 are in fluid communication with one another by insulated hose 42. Insulated hose 42 connects the fluid lines 38 of the assemblies A1/A2 and B1/B2.

Figure 3:
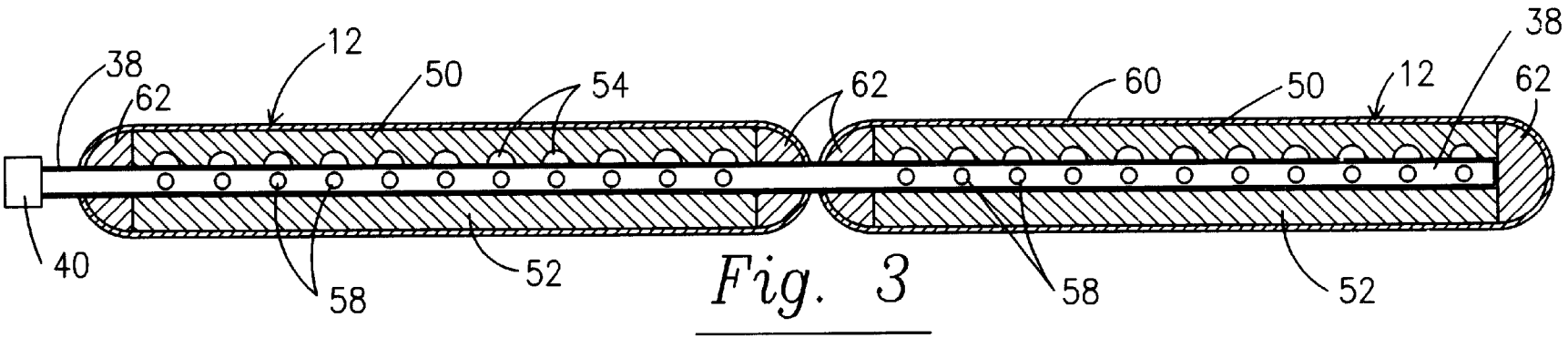
FIG. 3 is a cross sectional view of the pad assembly shown in FIG. 2 taken along lines 3—3.
Figure 4:
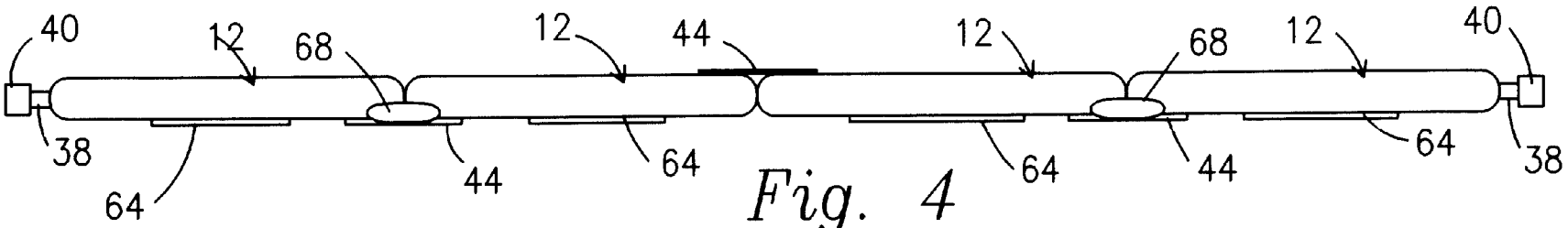
FIG. 4 is a side elevational view of the pad assemblies shown in FIG. 1.
Figure 5:
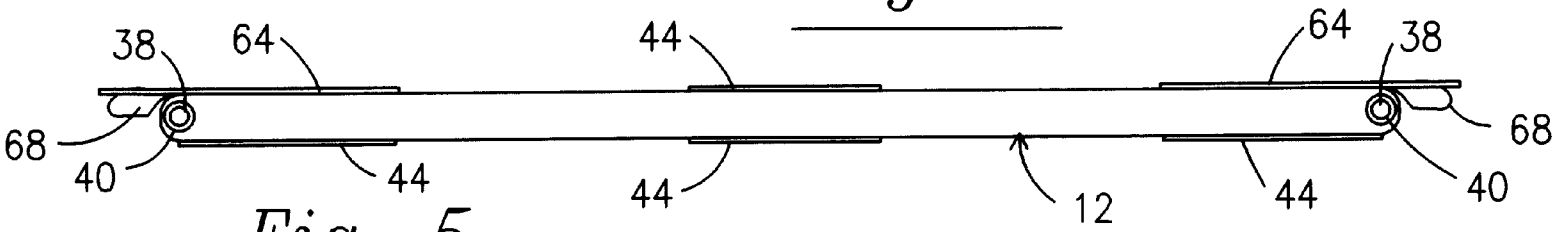
FIG. 5 is an end elevational view of the pad assembly shown in FIG. 2.

Fluid lines 38, as well as supply manifold 34, return manifold 32 and expansion tank 74, are all equipped with self-sealing quick disconnect style connectors 40. The ends of insulated hoses 24, 26, 28, 30, 36, 42, and 76 are all equipped with complementary self-sealing connectors which are easily connected and disconnected from the self-sealing quick disconnect style connectors 40. This provides a quick and easy way to connect and disconnect hoses and assemblies without fluid loss and further eliminates the use of valves. Suitable materials for fluid line 38 include any perforated hose material as shown in FIG. 3.

Fluid lines 38 are located at each end of pad assemblies A1, A2, B1 and B2. Each fluid line 38 is in fluid communication with evenly spaced channels or grooves 54 and 56 which are located in the top panel 50 and the bottom panel 52 of pad means 12, respectively, via apertures 58 as shown in FIGS. 2, 3 and 6–8. As shown in FIG. 3, fluid line 38 is sealed on one end and terminates with a self-sealing quick disconnect connector 40 on the other end.

Further, as shown in FIG. 1, the apparatus is a closed system in which the pad assemblies A1/A2 and B1/B2 are in fluid communication with each other at one end. The opposite end of pad assembly A1 is connected to insulated hose 26 which in turn is connected to return manifold 32. Similarly, the opposite end of pad assembly A2 is connected to insulated hose 24 which in turn is also connected to return manifold 32.

Also shown in FIG. 1, an inline expansion tank or bladder 74 is positioned between return manifold 32 and pump means 14. Expansion tank 74 is in fluid communication with both return manifold 32 and pump means 14 via insulated hose 76. Expansion tank 74 can be made of any known material provided that the material is capable of acting as a reservoir or holding tank for an environmentally safe antifreeze/water mixture which circulates through apparatus 10. Expansion tank 74 function as an overflow reservoir which may be necessary to prevent damage to apparatus 10, and in particular, to pad means 12, due to expansion of the environmentally safe antifreeze/water mixture. In addition, expansion tank 74 acts as a reservoir for the antifreeze/water mixture that is displaced from pad means 12 when vehicles or other objects are parked or placed on pad means 12, which prevents damage to pad means 12 due to pressure increases inside pad means 12.

The opposite end of pad assembly B1 is connected to insulated hose 30 which in turn is connected to supply manifold 34. Similarly, the opposite end of pad assembly B2 is connected to insulated hose 28 which in turn is also connected to supply manifold 34. Supply manifold 34 is in fluid communication with heater means 16. Heater means 16 is in fluid communication with pump means 14 via insulated hose 36 to complete the system. Supply manifold 34 supplies a heated solution of the environmentally safe antifreeze/water mixture from heater means 16 to pad assemblies B1 and B2.

Figure 6:
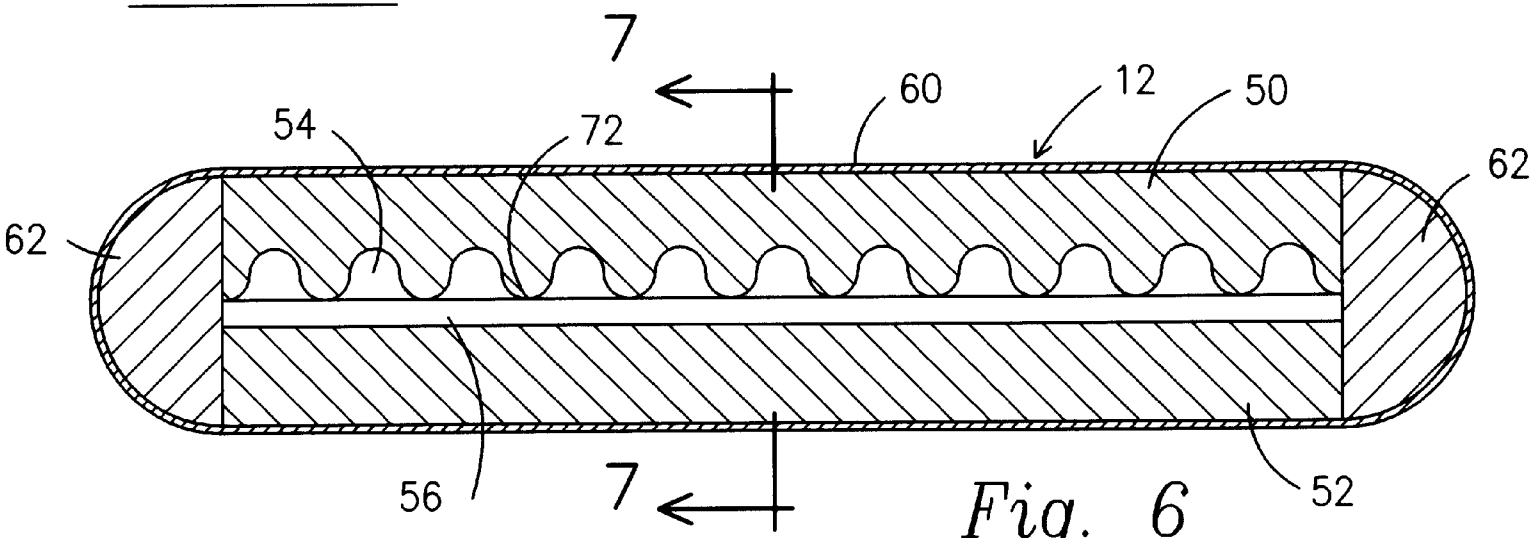
FIG. 6 is a cross sectional view of a pad means shown in FIG. 2 and FIG. 8 taken along lines 6—6.
Figure 7:
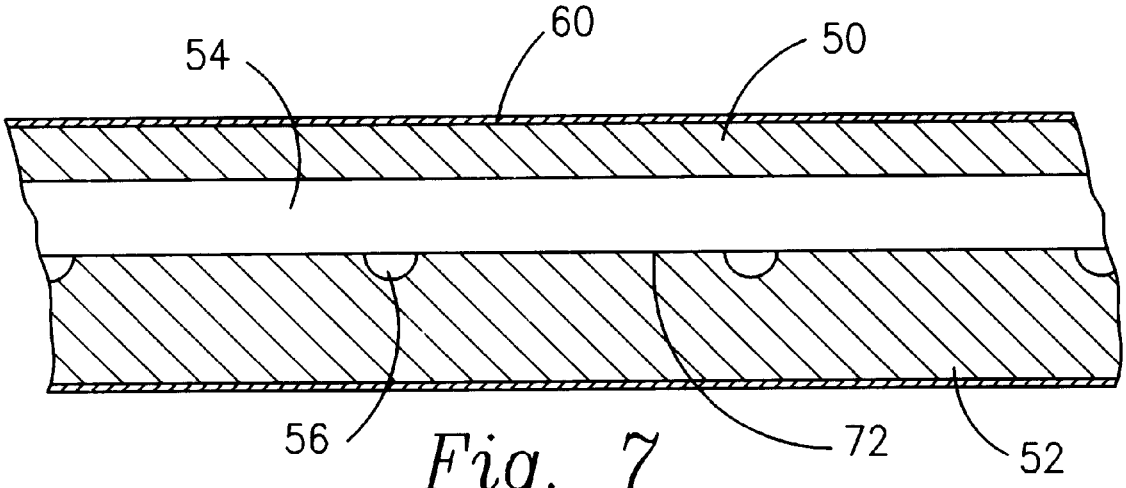
FIG. 7 is a cross sectional view of the pad means shown in FIG. 6 and FIG. 8 taken along lines 7—7.

An individual pad means 12 can be made of various lengths and widths depending on the particular surface area to be covered by the apparatus for preventing the accumulation of ice and snow. As shown in FIG. 3, pad means 12 is constructed of layers or panels of insulated material such as, but not limited to, polyurethane. Both the top panel 50 and the bottom panel 52, of pad means 12, are grooved on their inside surfaces in such a way as to create evenly spaced channels 54 which run the length of pad means 12 and evenly spaced channels 56 which run the width of pad means 12 when the top panel 50 and the bottom panel 52 are bonded together. As can be seen in FIG. 6, the top panel 50 and the bottom panel 52 are bonded together at points of contact 72 using a flexible and resilient adhesive thus forming the channels 54 and 56 through which heated fluid flows.

Channels 54 which run the length of the top panel 50 of pad means 12 provide a primary path for heated fluid to flow from the fluid line 38 at one end of pad means 12 to the fluid line 38 at the other end of pad means 12. Channels 56 which run the width of the bottom panel 52 of pad means 12 provide a secondary path for heated fluid to flow when the primary channels 54 are blocked by vehicular and/or pedestrian traffic. As one practical illustration, channels 56 are approximately half the radius of channels 54 and typically are spaced approximately eight (8) times the channel 54 distance apart. The channels 54 and 56 provide an uninterrupted path for the heated fluid to flow. Specifically, channels 54 and 56 form a matrix which allows the heated fluid to flow around an obstruction caused by a vehicle or other object with is parked or placed on the surface of pad means 12. End panels 62 of pad means 12 are also made of an insulated material such as, but not limited to, polyurethane. End panels 62 provide extra insulation and contour to pad means 12. In addition, pad means 12 may be sealed in a protective layer or surface covering 60, such as, but not limited to a waterproof, oil-resistant neoprene-impregnated fabric with a non-slip finish.

Individual pad means 12 are connected to each other and held together by connectors 64. Typically, connectors 64 are VELCRO® or a hook and eye mechanism which firmly secure pad means 12 together. Flexible handles 68 are positioned on various corners of pad means 12 to facilitate installation and removal for storage.

Figure 12:
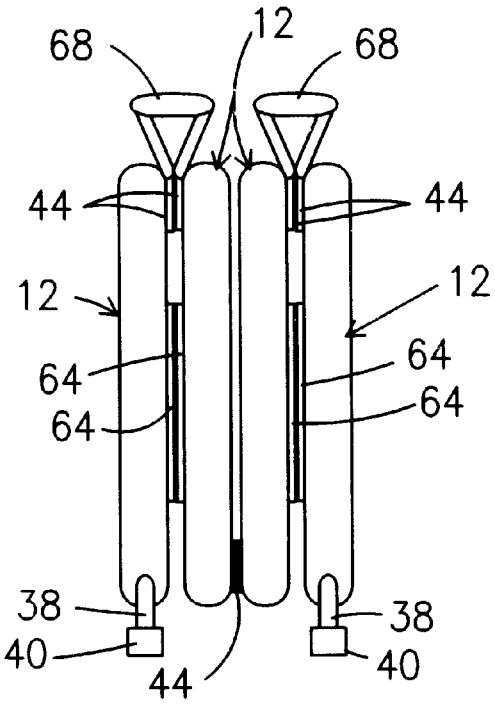
FIG. 12 is a side elevational view of the folded pad assemblies shown in FIG. 10.
Figure 8:
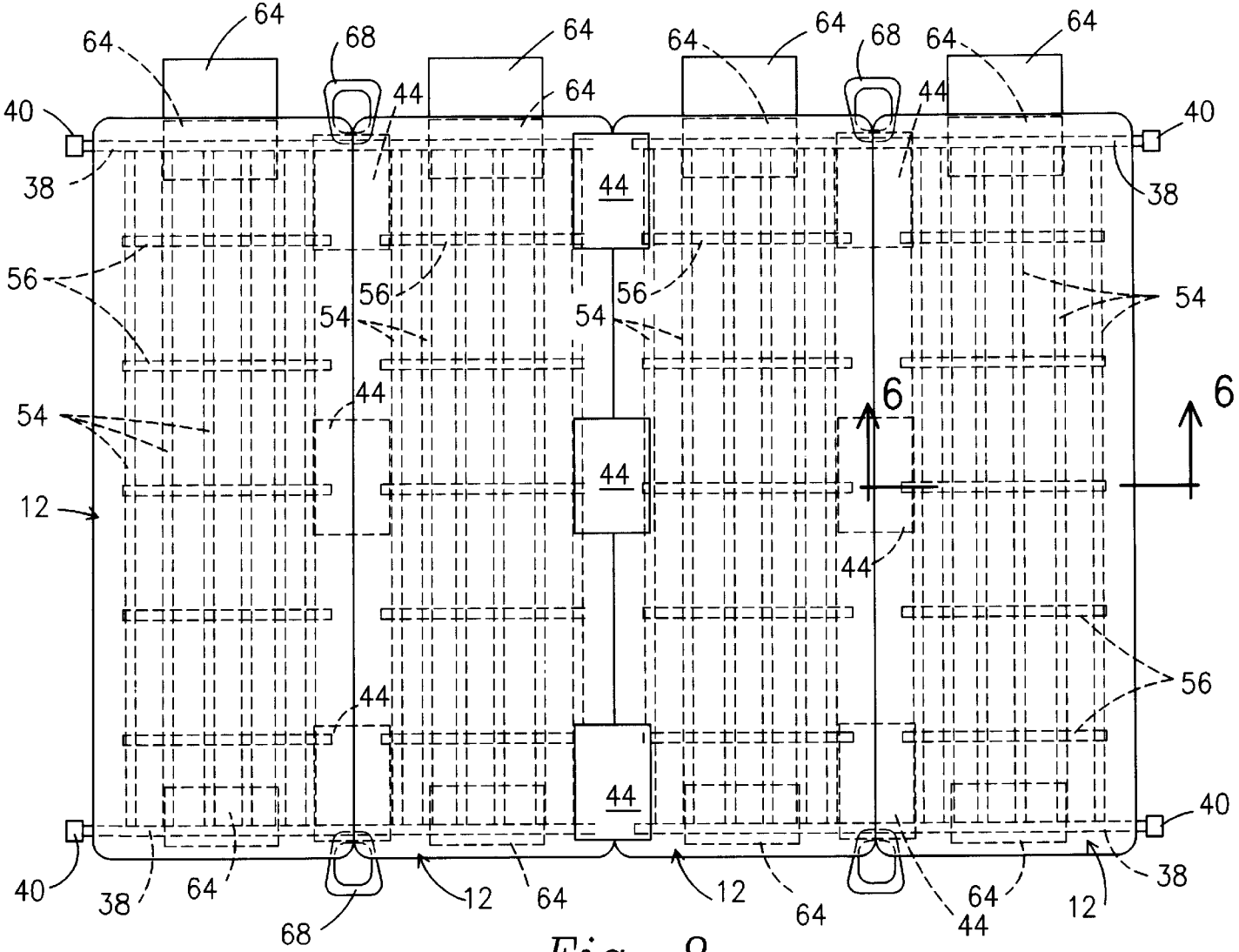
FIG. 8 is a top plan view of another embodiment of the pad assemblies of the present invention.
Figure 9:
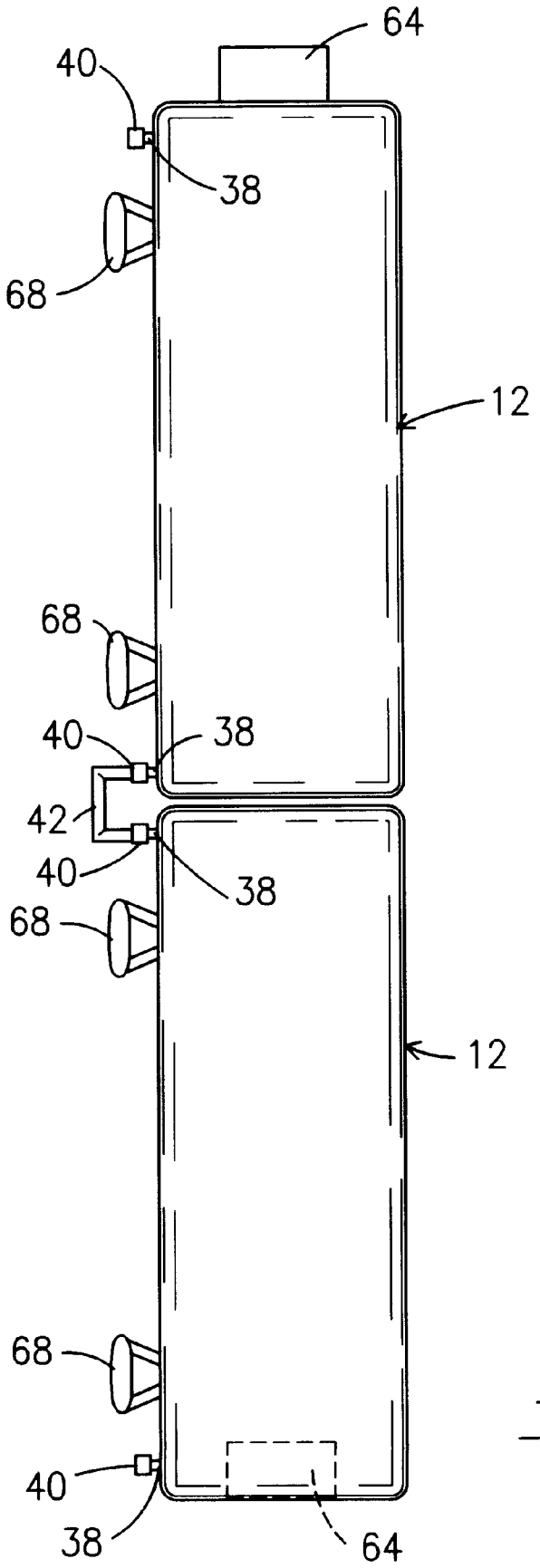
FIG. 9 is a top plan view of another embodiment of the pad assembly of the present invention.
Figure 10:
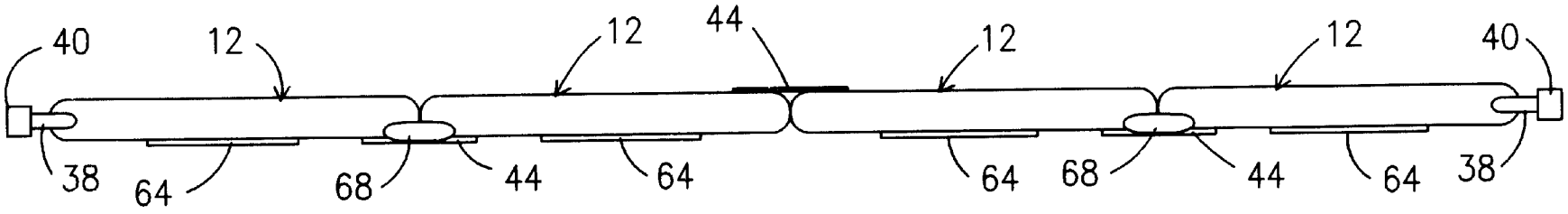
FIG. 10 is a side elevational view of the pad assemblies shown in FIG. 8.
Figure 11:
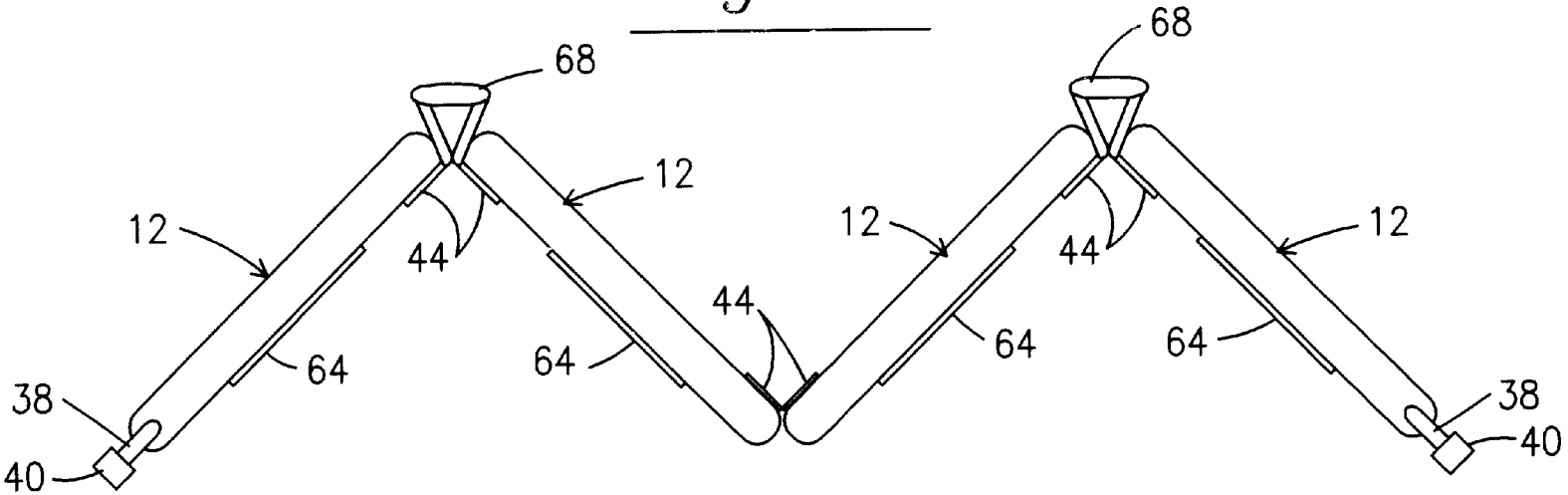
FIG. 11 is a side elevational view of the partially folded pad assemblies shown in FIG. 10.

Pad assemblies A1 and A2 can be easily transported and stored as demonstrated in FIGS. 10–12. FIG. 10 is a side elevational view of pad assemblies A1 and A2 as they would appear installed on a driveway surface. In preparation for storage, the handles 68 are lifted and the interconnecting panels 44 act as hinges allowing the heating pad assemblies A1 and A2 to fold upon themselves as shown in FIG. 11. The heating pad assemblies A1 and A2, shown in FIG. 12 have been lifted from the driveway surface, are completely folded and are ready for transport and storage. In narrower walkway or pathway configurations, shown in FIG. 9, pad means 12 are equipped with handles 68, as shown, for transport and storage.

Returning to FIG. 1, temperature regulation means 18 senses the temperature of the surface of the top panel 50 of a pad means 12. Typically, temperature regulation means 18 and 20 are automatic regulators. For example, temperature regulation means 18 is a sensor with a limit switch which is adjusted to activate pump control means 22 when the temperature of the top panel 50 of pad means 12 reaches a certain temperature. Typically, the temperature regulation means 18 has a limit switch which is set to activate pump control means 22 when the temperature of the top panel 50 of pad means 12 reaches just above freezing ±5 degrees.

Temperature regulation means 20 is located on the surface of the bottom panel 52 of a pad means 12 and senses the temperature of the driveway or walkway surface. Temperature regulation means 20 is a sensor with a limit switch which is adjusted to activate pump control means 22 when the temperature of the driveway or walkway surface under pad means 12 reaches a certain temperature which is typically above freezing but higher than the temperature of temperature regulation means 18. For example, the temperature regulation means 20 has a limit switch which is set to activate pump control means 22 when the temperature of the driveway of walkway surface reaches just below 40° F.±5 degrees. Temperature regulation means 18 and 20 can be set to activate pump control means 22 at other temperatures as well, depending on weather conditions. The use of temperature regulation means 18 and 20 prevents the surface which the pad means 12 covers from freezing thereby preventing damage to that surface which is sometimes caused by freezing. In addition, the use of temperature regulation means 18 and 20 provides a thermally stable foundation and wide range of operating temperatures. Temperature regulation means 18 and 20 are located near the return end of the pad assemblies A1 and A2, as shown in FIG. 1.

Heater means 16 is preferably a tankless heater which heats the fluid as pump means 14 moves the fluid through the heater means 16. Alternatively, heater means 16 is a pipe wrapped with resistance wire, an in-line heated probe or a heater mechanism which includes a reservoir. Heater means 16 has sufficient power capacity to maintain the necessary fluid temperature required for proper heating and operation of the apparatus.

Figure 13:
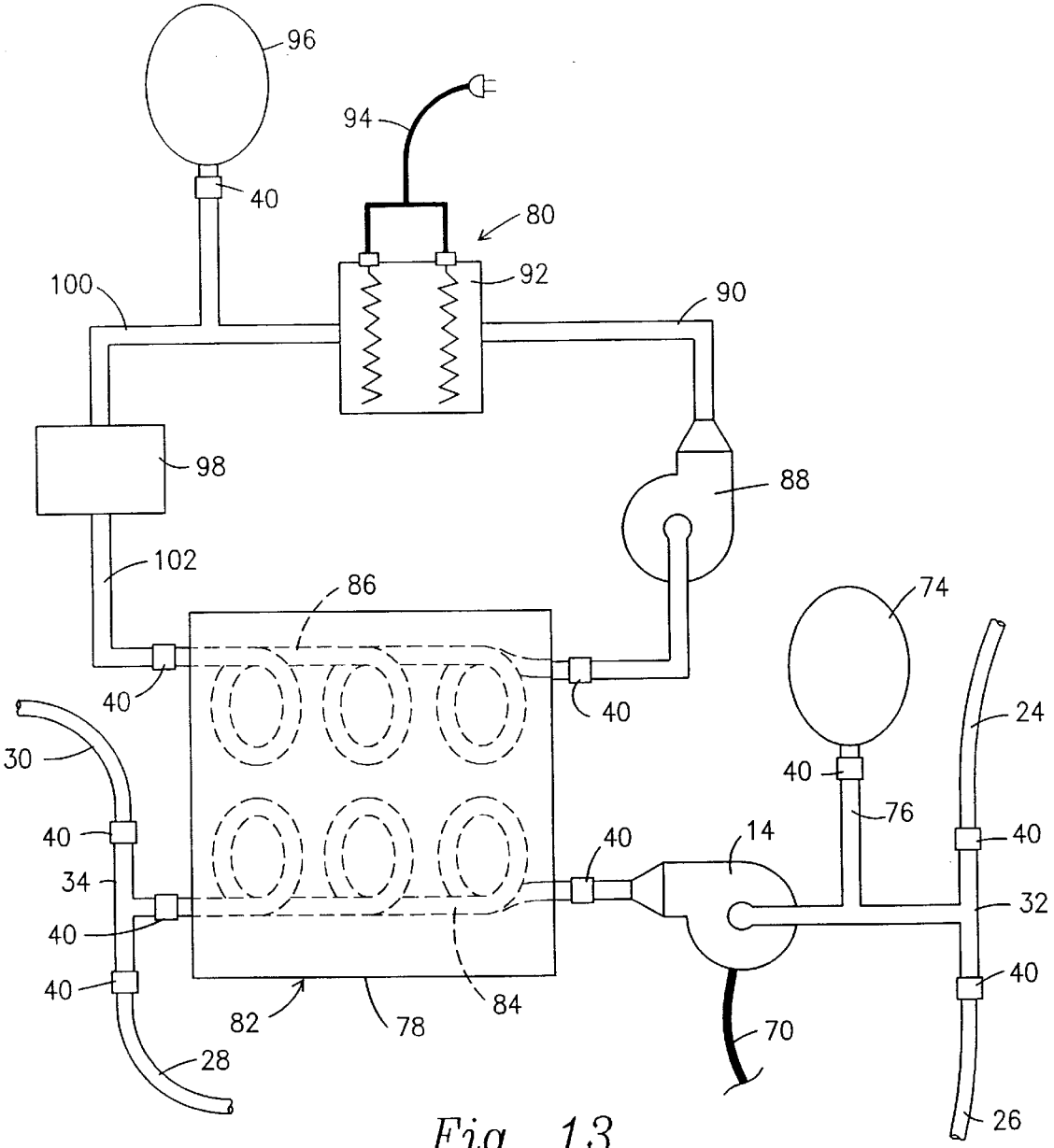
FIG. 13 is a top plan view of another embodiment of the heater means of the present invention.

An alternative embodiment of heater means 16 is shown in FIG. 13. As shown in FIG. 13, pump means 14 is in fluid communication with heat exchanger 78. Heat exchanger 78 includes a primary high pressure closed circuit 80 and a secondary low pressure closed circuit 82. The low pressure closed circuit 82 of heat exchanger 78 is in low pressure fluid communication with pump means 14 and manifold 34 via coil 84. Coil 86 of the high pressure closed circuit 80 of heat exchanger 78 is in fluid communication with pump 88. Coils 84 and 86 are typically made of any material which facilitates the transfer of heat from the high pressure circuit 80 to the low pressure circuit 82 of heat exchanger 78.

Typically, pump 88 can be any pump mechanism including, but not limited to, a reciprocating power pump, a steam pump, a rotary pump or a pistonless pump. As an illustrative example, pump 88 typically maintains a flow rate of from 1 to 5 gallons per minute. Pump 88 is also in fluid communication via insulated hose 90 with heater 92. Heater 92 is preferably connected to an electric power source (not shown) by electrical plug 94, however, other power sources are also contemplated by the present invention. Heater 92 is preferably a tankless heater which heats the fluid as pump 88 moves the fluid through the heater means 92. Alternatively, heater means 92 is a pipe wrapped with resistance wire, an in-line heated probe or a heater mechanism which includes a reservoir. Heater 92 has sufficient power capacity to maintain the necessary fluid temperature required for proper heating and operation of the high pressure closed circuit 80 of heat exchanger 78.

An in-line expansion tank or bladder 96 is positioned between heater 92 and temperature pressure valve 98. Expansion tank 96 is in fluid communication with both heater 92 and temperature pressure valve 98 via insulated hose 100. Expansion tank 96 can be made of any known material, provided that the material is capable of acting as a reservoir or holding tank. As an illustrative example, steam is circulated through the high pressure closed circuit 80 of heat exchange 78. In addition, high pressure hot water or any other hot fluid mixture can be circulated through the high pressure closed circuit 80 of heat exchanger 78. Expansion tank 96 functions as an overflow reservoir which may be necessary due to expansion of the fluid material in high pressure closed circuit 80 of heat exchanger 78.

Temperature/pressure value 98 is in fluid communication with coil 86 via insulated hose 102 to complete the circuit of the high pressure closed circuit 80 of heat exchanger 78. As shown in FIG. 13, self-sealing quick disconnect style connectors 40 and complimentary self-sealing connectors facilitate assembly and disassembly without fluid loss. Temperature pressure valve 98 is a safety mechanism that typically functions to maintain a desired temperature and pressure in the high pressure closed circuit 80 of heat exchanger 78. For example, in one embodiment, when the pressure inside the high pressure closed circuit 80 of heat exchanger 78 reaches or 50 psi or the temperature inside the high pressure closed circuit 80 of heat exchanger 78 reaches 212° F., temperature/pressure valve 98 vents to the environment.

Pump control means 22, typically is an automatic control mechanism which activates pump means 14 by sensing the position of temperature regulation means 18 and 20 located on the top panel 50 and bottom panel 52, respectively, of pad means 12. For example, pump control means 22 has a three-way switch, with settings "AUTO", "OFF", and "TEST". The "AUTO" mode of the three-way switch provides remote sensor control of temperature regulation means 18 and 20 of pad means 12. In the "AUTO" mode either temperature regulation means 18 or 20 can activate pump control means 22. The "OFF" mode provides a means of removing power to the pump control means 22, the heater means 16 and the pump means 14. The "TEST" mode provides a means of bypassing temperature regulation means 18 and 20 and activating pump means 14 and heater means 16 to check the system for proper operation and functioning.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for melting ice and snow, comprising:

a pad means;

a pump means;

a heater means;

a temperature regulation means; and a pump control means;

the pad means having a top panel, a bottom panel and two end panels, the top panel having evenly spaced vertical integral channels running the length of the pad means, the bottom panel having evenly spaced horizontal integral channels running the width of the pad means, the vertical channels and the horizontal channels being in fluid communication with each other and being in fluid communication with the pump means and the heater means and in electrical communication with the temperature regulation means and the pump control means, and the pump control means being in electrical communication with the pump means.

2. The apparatus according to claim 1 wherein the heater means is a tankless heater.

3. The apparatus according to claim 1 wherein the temperature regulation means comprises a limit switch located in the pad means top and bottom panels for activating pump control means at a predetermined temperature.

4. The apparatus according to claim 1 wherein the pump control means provides remote sensor control of temperature regulation means.

* * * * *